US011084633B2

(12) United States Patent
Le et al.

(10) Patent No.: US 11,084,633 B2
(45) Date of Patent: Aug. 10, 2021

(54) CONTAINER AND LID HAVING BOTH SNAP RING AND THREAD ENGAGEMENT

(71) Applicant: MATRIX BOTTLES, LLC, Wichita, KS (US)

(72) Inventors: Michael Nghiem Le, Wichita, KS (US); Kevin Robert Burch, Wichita, KS (US)

(73) Assignee: MATRIX BOTTLES, LLC, Wichita, KS (US)

( * ) Notice: Subject to any disclaimer, the term of this patent is extended or adjusted under 35 U.S.C. 154(b) by 87 days.

(21) Appl. No.: 16/537,344

(22) Filed: Aug. 9, 2019

(65) Prior Publication Data

US 2020/0299036 A1 Sep. 24, 2020

Related U.S. Application Data

(60) Provisional application No. 62/820,378, filed on Mar. 19, 2019.

(51) Int. Cl.
*B65D 43/02* (2006.01)
*B65D 45/18* (2006.01)

(52) U.S. Cl.
CPC ..... *B65D 43/0229* (2013.01); *B65D 45/18* (2013.01); *B65D 2543/00842* (2013.01)

(58) Field of Classification Search
CPC ..... B65D 43/021; B65D 43/0229; B65D 43/0225; B65D 43/0202; B65D 45/18; B65D 45/16; B65D 41/04; B65D 41/0407; B65D 41/0435; B65D 41/06
USPC ..... 220/296, 295, 293, 304, 288, 324, 315, 220/803, 802, 804, 806, 801, 796, 270, 220/266, 795, 794, 789, 780; 215/360, 215/356, 355, 216, 253, 254, 252, 250
See application file for complete search history.

(56) References Cited

U.S. PATENT DOCUMENTS

| | | | | |
|---|---|---|---|---|
| 3,458,079 | A * | 7/1969 | Gasbarra | B65D 43/0208 220/787 |
| 2008/0017642 | A1* | 1/2008 | King | B65D 51/1688 220/285 |
| 2016/0046415 | A1* | 2/2016 | Buck | B65D 43/026 220/256.1 |
| 2019/0248553 | A1* | 8/2019 | Minnette | B65D 50/046 |
| 2020/0122905 | A1* | 4/2020 | Agrawal | B65D 43/0229 |

* cited by examiner

*Primary Examiner* — Robert J Hicks
(74) *Attorney, Agent, or Firm* — Robert Blinn

(57) ABSTRACT

A container includes a container portion and a lid portion. The container portion presents a tab rim and internal threads. The lid portion presents a plurality of flexible removable tabs disposed around its outer periphery. The tabs are adapted to engage with and interlock with the container tab rim when the lid portion is pressed down on the container. The lid portion also has helical threads that are arranged to engage the helical threads of the container portion. At least one of the set of helical threads of the container portion or the set of helical threads of the lid portion are able to flex when the lid portion is pressed down upon the container portion. A closed container may be adapted for repeated use by removing the tabs and using the threaded lid portion to open and close the container.

8 Claims, 3 Drawing Sheets

CONTAINER AND LID HAVING BOTH SNAP RING AND THREAD ENGAGEMENT

CROSS REFERENCES TO RELATED APPLICATIONS

This application claims the benefit of Provisional Utility Application 62/820,378 filed on Mar. 19, 2019 which is incorporated herein by reference.

FIELD

This invention relates to a container and lid arrangement wherein a lid portion is able to engage a container portion with a snap ring and with corresponding threads.

BACKGROUND

Buckets or containers for bulk materials typically have one type of lid or closure structure that includes a snap ring structure that is adapted to clip around a downwardly oriented outside rim that is disposed around the opening of the container. What is needed a container and lid system wherein the lid may be pushed down upon the container to install the lid portion with a very low cycle time in an assembly line packing process and yet that may also be used as a lid that is able to be engaged and disengaged with the container by means of corresponding threads arranged within the container and on the lid.

SUMMARY

The above described need is addressed by a container having a container portion and a corresponding lid portion having two sets of corresponding features for permitting the installation of the lid portion with rapid non-rotating insertion of the lid portion and removal and replacement of the lid portion by means of rotation to disengage and re-engage corresponding threads within the container and on the lid portion. The present container features a round container portion that presents a radially projecting outboard rim that preferably includes a downwardly oriented outside flange that is uniformly spaced away from the outside surface of the container portion, as is well known in the art. The lid portion presents a plurality of tabs that are shaped to bend outward and then engage the outboard rim of the container portion as the lid portion is pushed down upon the container portion as is also well known in the art. The tabs are fixed to the periphery of the lid portion at scored zones that make it possible to easily snap the tabs away from the lid portion. The presence of the tabs indicates that the container has not been opened after the point in time when any contents were placed in the container. Optionally, the joints between the plurality of tabs and the lid portion may include a removable strip that may be pulled and removed to rapidly remove all of the tabs. The lid portion also presents an offset surface that presents a pattern of lid portion threads. The lid portion threads have arcuate cross sections and are generally oriented upwardly. The upper inside surface of the container portion presents a pattern of container portion threads. The container portion threads have arcuate cross sections that are generally oriented downwardly. The container portion threads and the lid portion threads are preferably fashioned from a flexible molded plastic and are spaced and arranged to interfere to a limited degree so that it is possible to push the lid portion down upon the container portion as the threads deform to allow passage of the corresponding threads over each other. However, once the plurality of tabs are engaged with the outboard rim of the container portion and the lid portion threads have been received by the flexing of both the lid portion threads and the container portion threads, the preferred method for removing the lid portion is to remove the tabs and unscrew the lid portion from the container portion. Once the tabs are removed, the lid portion may be removed and replaced using the corresponding container portion and lid portion threads as many times as is desired.

DETAILED DESCRIPTION

Figure 1:
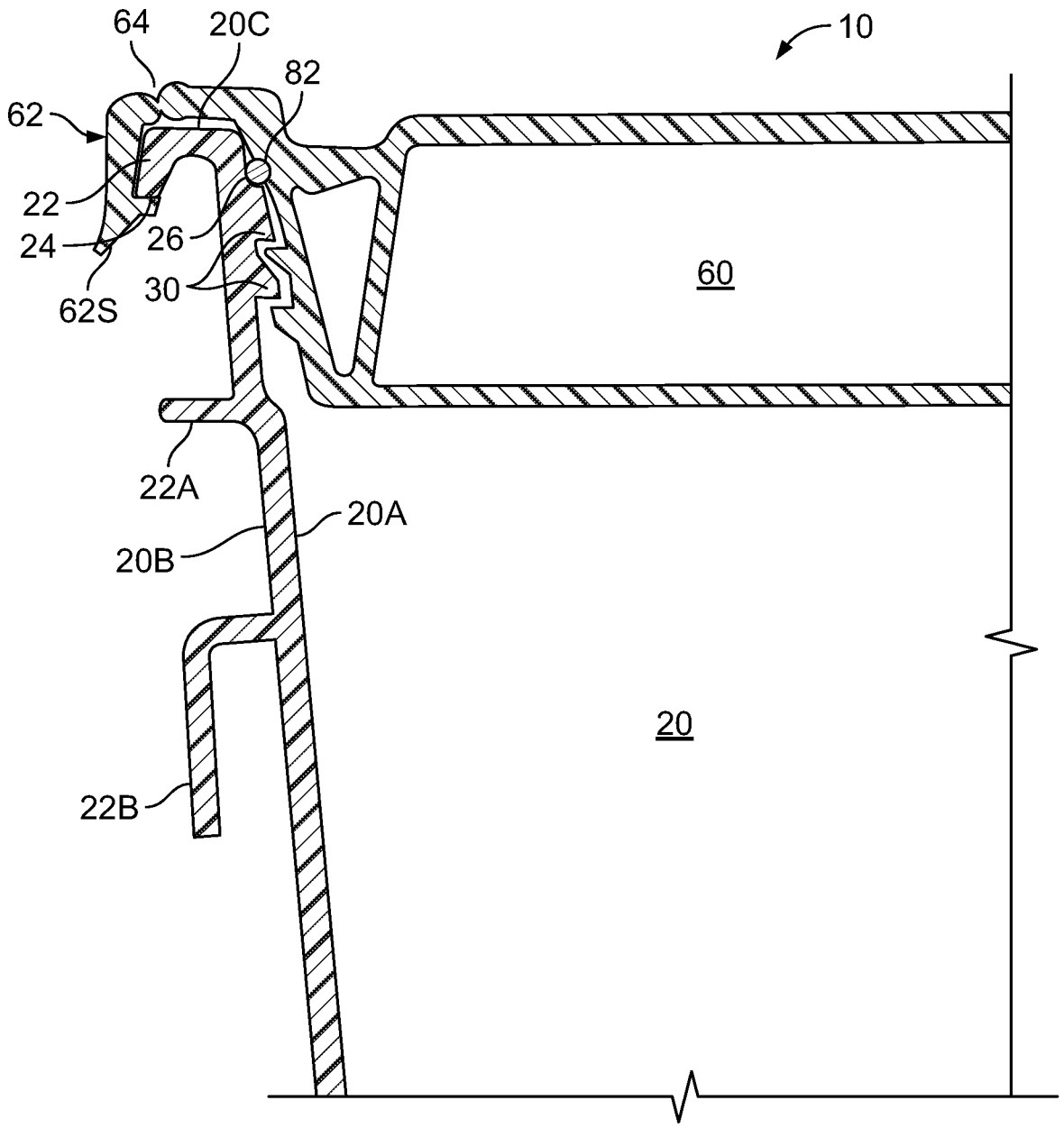
FIG. 1 is a partial cross section view of a container portion with a lid portion installed showing an embodiment of the present container.
Figure 2:
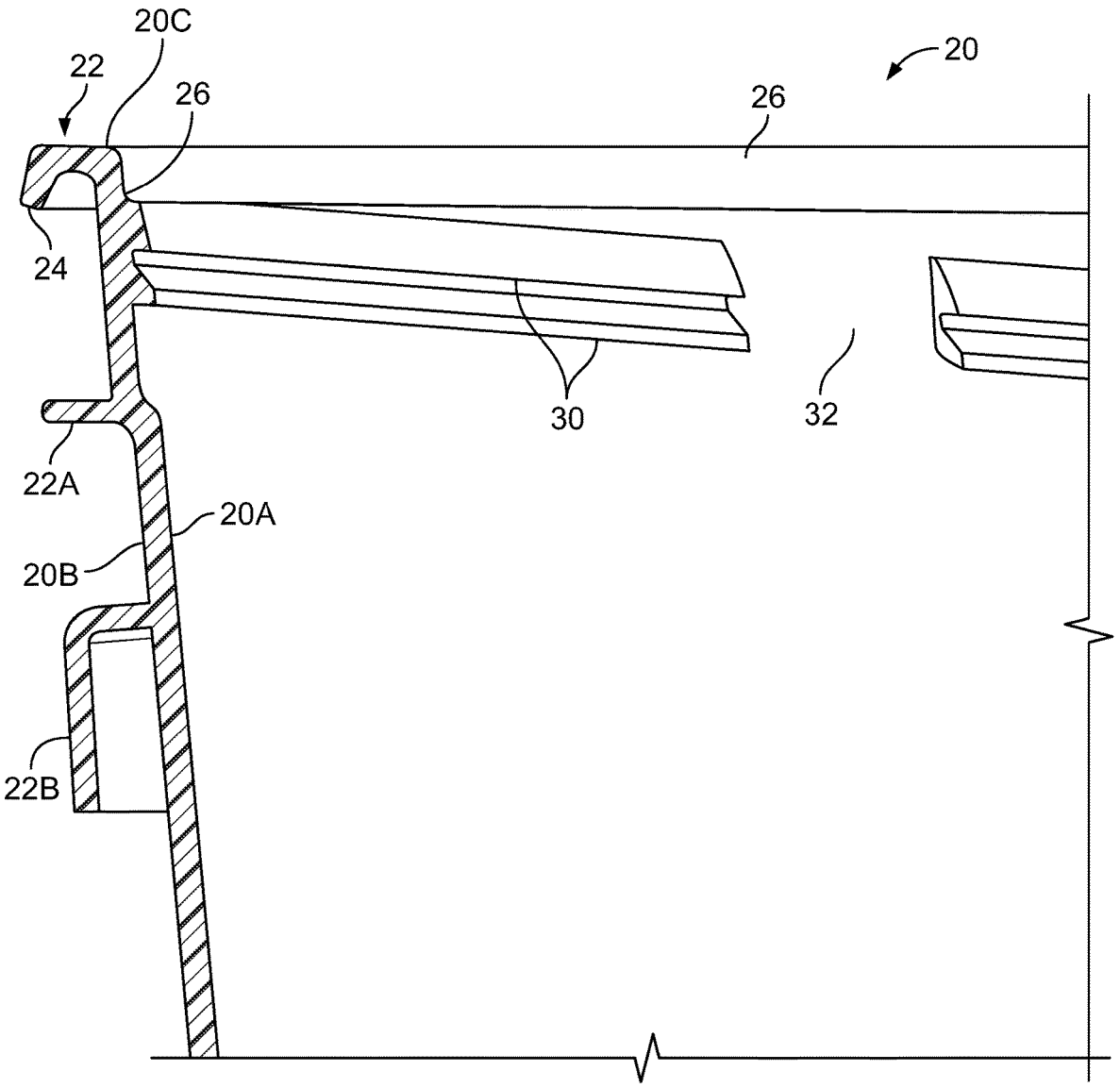
FIG. 2 is a partial cross section view of the container of FIG. 1.
Figure 3:
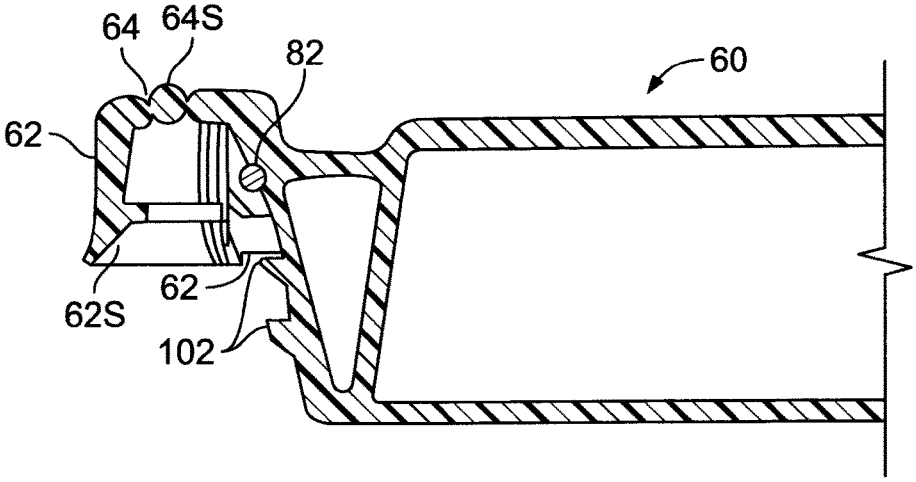
FIG. 3 is a partial cross section view of the lid portion of FIG. 1.

Referring to the drawings, FIGS. 1-3 illustrate an embodiment of a container 10. Container 10 includes, a container portion 20 and a lid portion 60.

FIG. 2 illustrates container portion 20 of container 10. In this example, container portion 20 may be a five gallon bucket similar to the generally round (circular) five gallon buckets that are used as containers for bulk products such as paint, cosmetic preparations or even food products and the like. FIG. 2 provides only a partial cross section view of container portion 20. Those skilled in the art would be well acquainted with the various features that would be presented by remainder of container 10 which is not shown in FIG. 2. As can be seen in FIG. 2, container portion 20 includes an inside surface 20A and an outside surface 20B and an open upper rim 20C. A tab rim 22 projects radially around open upper rim 20C of container portion 20. Tab rim 22 projects around upper rim 20C of container portion 20 in an evenly offset manner. Tab rim 22 presents a downwardly oriented edge 24. As is shown in FIG. 2, the outside surface of container portion 20 may optionally present circumferential features 22A and 22B that are well known in the art and that are shown here for illustrative purposes only. An optional O-Ring ledge 26 is arranged around the inside surface of container portion 20 near upper rim 20C. A set of threads 30 is disposed around inside surface 20A near upper rim 20C. As can be seen in FIG. 2, set of threads 30 is arranged in a typical helical pattern. As is shown in FIG. 2, it is optional and even preferable to have a plurality of preferably evenly spaced gaps 32 defined in threads 30. Threads 30 have a downwardly oriented arcuate cross sections. Because container portion 20 is fashioned from molded flexible plastic, it is contemplated that, with sufficient force, it is possible to deform the inside edges of threads 30 inwardly. Such deformations of threads 30 would occur when lid portion 60 is pushed down upon container portion 20 as will be described in greater detail below.

FIG. 3 illustrates lid portion 60. As can be seen in FIG. 1, lid portion 60 is arranged to be received by container portion 20. Lid portion 60 has three features that are adapted for engaging with container portion 20 and securing or sealing lid portion 60 with container portion 20, namely, a plurality of tabs 62, an optional O-ring 82 and a set of threads 102. Each tab 62 presents an inwardly sloped surface 62S that flexes and rides upon the outer surface tab rim 22 of container portion 20 until the inwardly projecting portion of tab 62 catches under tab rim 22. This is envisioned to occur when lid portion 60 is pushed down upon container portion 20 with sufficient force during a high speed industrial process for closing container and lid portion arrangement 10. Between each tab 62 and the remainder of lid portion 60 is a narrow scored section 64 that facilitates the later removal of tab 62. An optional strip tab 64S may also be employed for removing all of tabs 62 quickly and easily. The skilled reader will note that the presence of tabs 62 indicates that the container has not been opened subsequent to the filling of container portion 20 with product.

Figure 4:
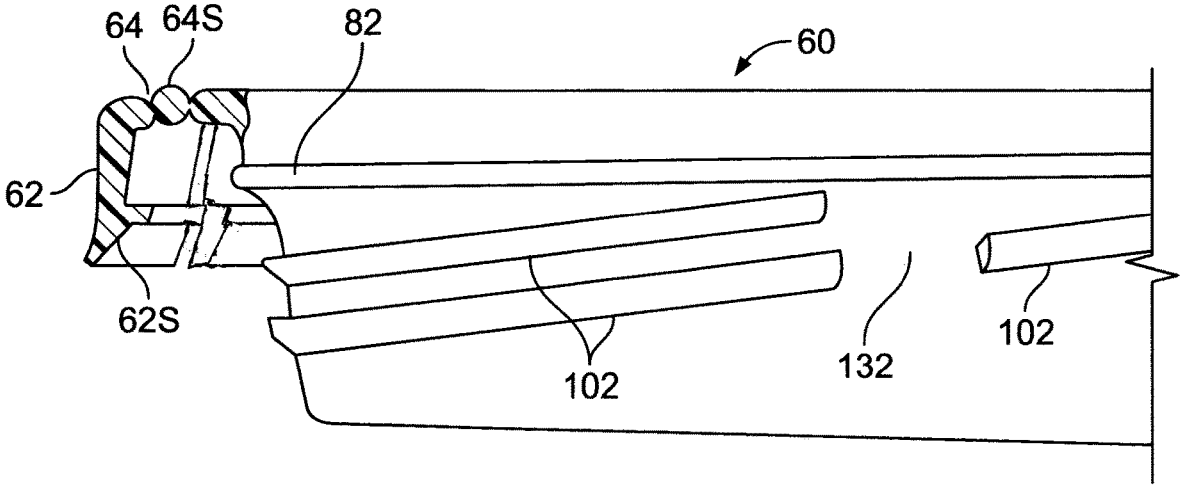
FIG. 4 is a second partial cross section view of the lid portion of FIG. 1 that shows more of the outer side surface of the lid portion than FIG. 1.

FIG. 3 and FIG. 4 shows that the outside surface of lid portion 60 that is inboard of tabs 62 presents a pattern of threads 102. Threads 102 are shaped and arranged to engage threads 30 of container portion 20. In this example, threads 102 also have arcuate cross sections, however, threads 102 are oriented upwardly. Thus, it is envisioned that as lid portion 60 is pressed down upon container portion 20 and if threads 102 of lid portion 60 and threads 30 of container portion 20 are correctly clocked, threads 30 will flex out as threads 102 flex in as threads 102 pass over threads 30 until threads 102 and 30 clear each other, flex back and then interlock. This engagement of threads 102 and threads 30 is envisioned to occur as lid portion 60 is pressed down upon container portion 20 in the industrial closure process noted above. As can be seen in FIG. 4, threads 102 also include evenly spaced gaps 132 that are preferably aligned with gaps 32 of container portion 20 when lid portion 60 is pressed down upon container portion 20 during the above noted high speed closure process. These periodic interruptions in threads 30 and threads 102 facilitate the flexing of threads 30 and 102 as they pass over each other during the above noted pressing closure process. It is also envisioned that optional O-ring 82 of lid portion 60 will seat on option ledge 26 of container portion 20 as lid portion 60 is pressed down upon container portion 20 during the above noted closure process thereby insuring a preferably air-tight seal for container and lid portion system 10.

As noted above, once closed container 10 is in the possession of a customer who will open and use the contents of container 10, tabs 62 may be removed as described above. Then, it is possible to simply unscrew lid portion 60 and later re-install lid portion 60 by merely screwing lid portion 60 back into container portion 20. With this arrangement it is now possible to install lid portions very rapidly in an industrial container filling process and to later use those same containers as re-usable containers with threaded lid portions. Screwing in lid portion 60 after tabs 62 have been removed from lid portion 60 will still result in re-establishing the above noted air-tight seal because of the presence of optional o-ring 82 and optional o-ring ledge 26 which will make contact with each other and preferably establish an air tight seal between lid portion 60 and container portion 20.

It is to be understood that while certain forms of this invention have been illustrated and described, it is not limited thereto, except in so far as such limitations are included in the following claims and allowable equivalents thereof.

Having thus described the invention, what is claimed as new and desired to be secured by Letters Patent is:

1. A container, comprising:

a container portion having an inside surface, an outside surface and an open upper rim, an outwardly projecting tab rim arranged around outside surface adjacent to the open upper rim, a set of helical container portion threads arranged around the inside surface of the container below the upper rim, a lid portion having a plurality of flexible removable lid portion tabs that are disposed around the outer periphery of the lid portion that are suitable for flexibly engaging and interlocking with the outwardly projecting tab rim of the container portion when the lid portion is pressed down upon the container portion, the lid portion also having a set of helical lid portion threads disposed thereon that are arranged to threadably engage the container portion threads, the lid portion threads being arranged to correspond with and threadably engage the container portion threads, at least one of the set of container portion threads or the set of lid portion threads being sufficiently flexible so as to flex and then interlock with the other of the corresponding set of threads if the lid portion is pressed down upon the container portion, whereby, if the tabs are removed from the lid portion, the lid portion is able to be unscrewed from the container by employing the corresponding container portion threads and lid portion threads and screwed back into the container portion by employing the corresponding container portion threads and lid portion threads for repeated removal and replacement of the lid portion as the interior of the container is repeatedly accessed.

2. The container of claim 1, wherein, the lid portion tabs are fixed to the lid portion by a strip that is arranged to be manually removed for removing all of the lid portion tabs from the lid portion.

3. The container of claim 1, wherein, at least one of the container portion threads and the lid portion threads have spaced interruptions for increasing the flexibility of the threads to facilitate pressing the lid portion down onto the container.

4. The container of claim 1, wherein, the container portion threads and the lid portion threads have spaced interruptions for increasing the flexibility of the threads to facilitate pressing the lid portion down onto the container portion.

5. The container of claim 4, wherein, the lid portion tabs are fixed to the lid portion by a strip that is arranged to be manually removed for removing all of the lid portion tabs from the lid portion.

6. The container of claim 1, wherein, the outwardly projecting rim tab has an arcuate cross section with a downwardly sloped outside surface.

7. The container of claim 4, wherein, the container portion threads have upper surfaces that are downwardly sloped and the lid portion threads have lower surfaces that are upwardly sloped in order to further facilitate the passage of the lid portion threads over the container portion threads when the lid portion is pressed down upon the container portion.

8. The container of claim 1, wherein, one of the container portion or the lid portion includes an o-ring that is arranged to seal with the other of the container portion or the lid portion when the lid portion is installed on the container portion.

* * * * *